US006779233B2

(12) United States Patent
Migli

(10) Patent No.: US 6,779,233 B2
(45) Date of Patent: Aug. 24, 2004

(54) LOW-BULKINESS SINGLE-PIN HINGE WITH MULTIPLE ADJUSTMENT FOR FURNITURE

(75) Inventor: Carlo Migli, Lecco (IT)

(73) Assignee: Agostino Ferrari S.p.A.

( * ) Notice: Subject to any disclaimer, the term of this patent is extended or adjusted under 35 U.S.C. 154(b) by 0 days.

(21) Appl. No.: 10/235,095

(22) Filed: Sep. 6, 2002

(65) Prior Publication Data

US 2003/0061683 A1 Apr. 3, 2003

(30) Foreign Application Priority Data

Sep. 28, 2001 (IT) ..... MI20010535 U

(51) Int. Cl.[7] ..... E05D 7/04
(52) U.S. Cl. ..... 16/246; 16/238; 16/240
(58) Field of Search ..... 16/233, 235–238, 16/242, 245, 246

(56) References Cited

U.S. PATENT DOCUMENTS 4,407,044 A * 10/1983 Iseki ..... 16/237
4,493,129 A * 1/1985 Grass ..... 16/238
5,283,929 A * 2/1994 Lin ..... 16/237
5,392,493 A * 2/1995 Youngdale ..... 16/237
5,412,840 A * 5/1995 Lautenschlager et al. ..... 16/238
5,419,085 A * 5/1995 Imbur ..... 16/238
5,887,316 A * 3/1999 Ferrari et al. ..... 16/245
5,930,866 A * 8/1999 Rupprechter ..... 16/242
6,049,946 A * 4/2000 Cress et al. ..... 16/240
6,240,599 B1 * 6/2001 Peer et al. ..... 16/240
6,460,219 B2 * 10/2002 Domenig et al. ..... 16/240
6,470,531 B2 * 10/2002 Domenig et al. ..... 16/240

* cited by examiner

*Primary Examiner*—Lynne H. Browne
*Assistant Examiner*—Christopher Boswell
(74) *Attorney, Agent, or Firm*—Shlesinger, Fitzsimmons & Shlesinger

(57) ABSTRACT

A single-pin hinge for furniture comprises a base (11) and a fastening bowl (12). Pivotally mounted on the bowl (12) is the end (14) of a pivoting arm (15) the opposite end of which (16) is rectilinear and slidably mounted to an extremity of an L-shaped element (17). The other extremity of the element (17) is slidably mounted to the base (11). Disposed between one extremity (18) of the L-shaped element and the base (11) is first means (20) for adjustment of the mutual position of same in their sliding direction (21) whereas between the other extremity (19) of the L-shaped element and the rectilinear end (16) of the pivoting arm is second means (23) for adjustment of the mutual position of same in their sliding direction (22).

13 Claims, 3 Drawing Sheets

Tav. I

Sez A-A

Tav. II

Tav. III

LOW-BULKINESS SINGLE-PIN HINGE WITH MULTIPLE ADJUSTMENT FOR FURNITURE

BACKGROUND OF THE INVENTION

The present invention relates to a hinge for furniture of the single-pin type called "frame".

In particular, the invention relates to an innovative frame hinge structure enabling a precise and easy position adjustment in two or, advantageously, three main directions.

For furniture built with a system involving a bearing face frame (widely spread on the American market), single-pin hinges with high adjustment capabilities are increasingly more requested on the market. A problem in offering a complex adjustment in hinges of the frame type is represented by the increased sizes of the frame brought about thereby. In fact, the "frame" construction for furniture already gives rise to an important clearance reduction in the piece of furniture so that achievement of a minimum bulkiness of the hinges within the piece of furniture itself becomes of importance.

This is in conflict with the desire of offering a high and accurate degree of adjustment of the hinge preferably in all the three orthogonal space directions. Hinges have been proposed which have a hinge arm fastened to the base upon interposition of an adjusting screw enabling sliding of the arm with respect to the base. This however supplies adjustment in a single direction and does not at all solve the problem of obtaining further adjustment without increasing the hinge sizes too much.

It is a general aim of the present invention to obviate the above mentioned drawbacks by providing a single-pin hinge of the frame type having high capabilities of accurate adjustment while keeping the hinge bulkiness small.

SUMMARY OF THE INVENTION

In view of the above aim, in accordance with the invention a single-pin hinge for furniture has been conceived which comprises a base and a fastening bowl designed to be secured to two parts of the piece of furniture to be hinged on each other around an axis, to the bowl being pivotally mounted, in accordance with said axis, one end of an arm having a rectilinear opposite end and an L-shaped connecting element having a first and a second opposite extremities, the first extremity of the "L" being constrained to slide in a direction parallel to its extension on said base, said rectilinear opposite end of the arm being constrained to slide in a direction parallel to its extension on the second "L" extremity, first rotating means being disposed between the first "L" extremity and the base for adjustment of the mutual position of same in their sliding direction and second rotating means being disposed between the second "L" extremity and the rectilinear arm end for adjustment of the mutual position of same in their sliding direction, the first and second rotating means having rotation axes parallel to each other.

BRIEF DESCRIPTION OF THE DRAWINGS

For better explaining the innovative principles of the present invention and the advantages it offers over the known art, a possible exemplary embodiment applying these principles will be described hereinafter, with the aid of the accompanying drawings. In the drawings.

DETAILED DESCRIPTION OF THE INVENTION

Figure 1:
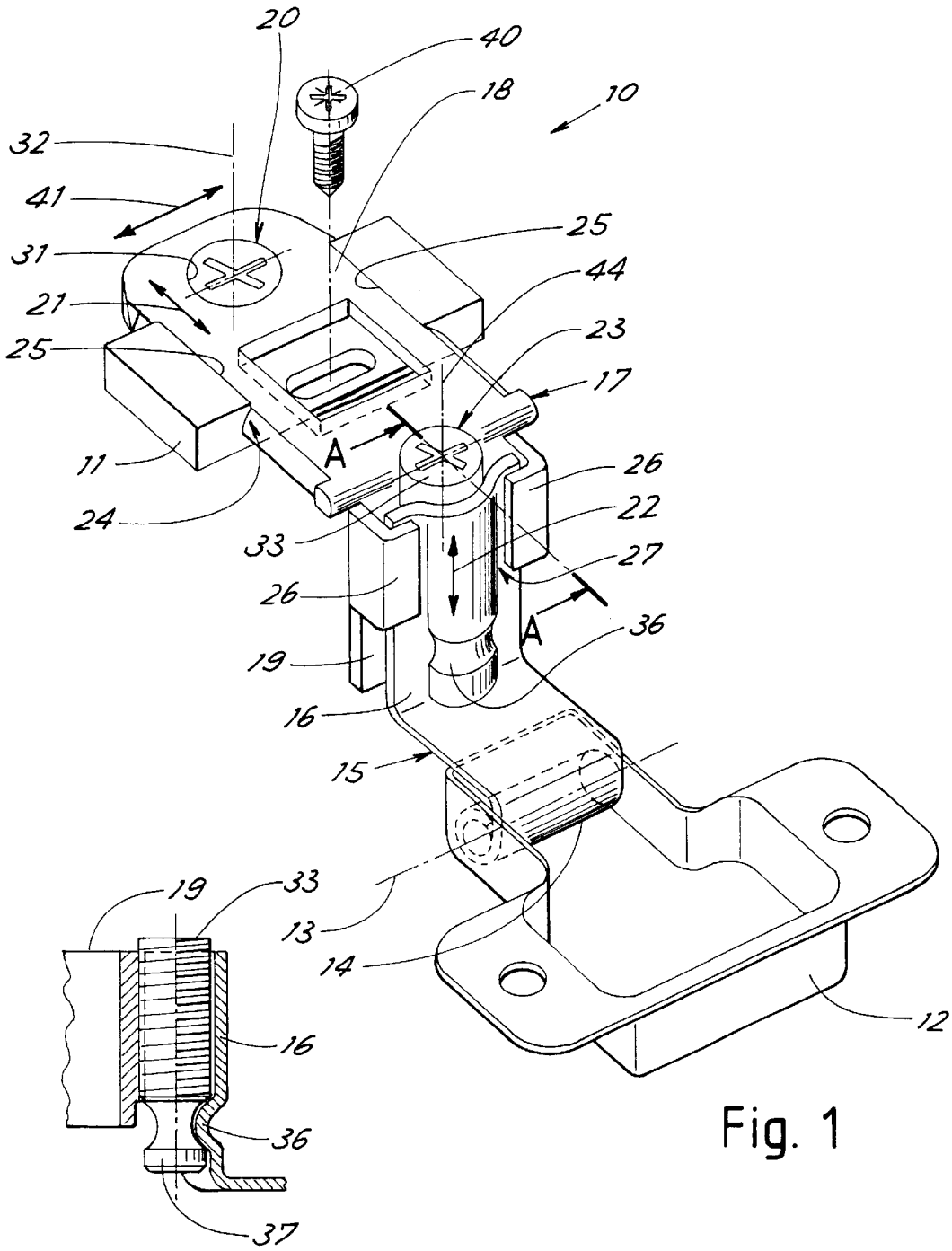
FIG. 1 is a diagrammatic perspective view of a hinge in accordance with the invention shown in an open condition.

With reference to the drawings, shown in FIG. 1 is a single-pin hinge generally denoted at 10, comprising a base 11 and a fastening bowl 12 designed to be secured to two parts of the piece of furniture to be hinged on each other around an axis 13.

An end 14 of a pivoting arm 15 is pivotally mounted to bowl 12 according to axis 13, the opposite end 16 of said arm being rectilinear. An L-shaped connecting element 17 has a first extremity or side 18 constrained to slide in the direction of its extension on the base, and a second opposite extremity or side 19 on which the rectilinear end 16 of the pivoting arm 15 is constrained to slide. Advantageously, the L-shaped element and pivoting arm are made of bent sheet metal.

Figure 2:
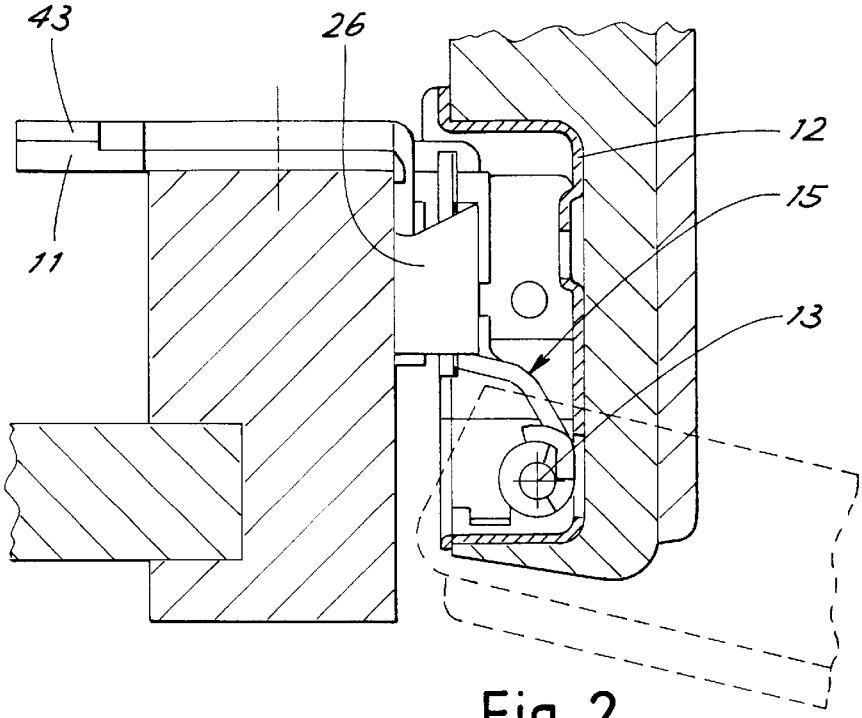
FIG. 2 is a side view of the hinge in FIG. 1 mounted to a piece of furniture and in a closed position.

As well-apparent in FIG. 2, for optimisation of the overall dimensions, when the hinge is in a closed position the second L extremity is disposed parallel to the bowl bottom 12 whereas the first extremity is disposed normal to the bowl bottom and close to a bowl side opposite to the hinging axis of the arm on the bowl.

Disposed between the first L extremity 18 and the base 11 is first means 20 for adjustment of the mutual position of same in their sliding direction 21. Disposed between the second L extremity 19 and the rectilinear end 16 of arm 15 is second means 23 for adjustment of the mutual position of same in their sliding direction 22.

Figure 4:
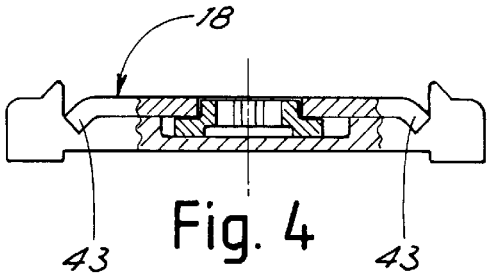
FIG. 4 is a view partly sectioned along line IV—IV in FIG. 3.
Figure 7:
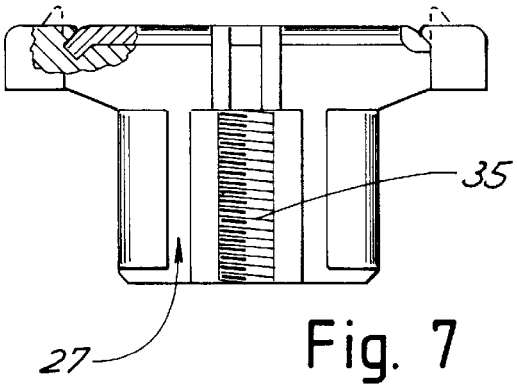
FIG. 7 is a partly sectioned front view of part of the hinge.

For providing a sliding coupling between the base and L-shaped element, base 11 defines an open-top rectilinear channel 24 in which said first extremity slidably fits. The channel has side walls provided with edges 25 projecting inwardly of the seat so as to constitute a sliding guide for the first L extremity 18. As clearly shown in FIGS. 4 and 7, said edges 25 can be advantageously obtained during the hinge mounting by downward bending of the channel sides after insertion of the L side thereinto. As shown in FIG. 4, sides 43 of the L extremity 18 are advantageously slightly bent downward for fitting into the two side guides in the base.

Figure 5:
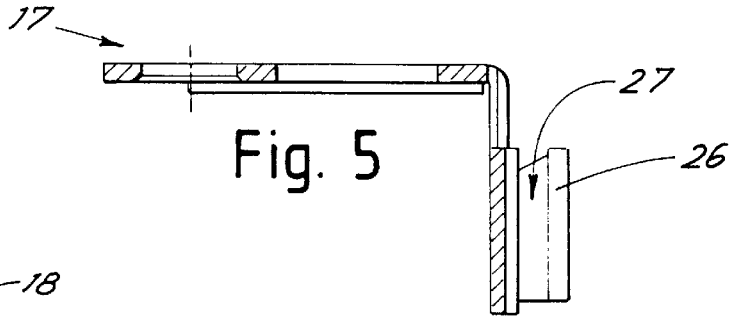
FIG. 5 is a view sectioned along line V—V in FIG. 3, of a detail of the hinge.

For providing a sliding coupling between the L-shaped element and pivoting arm, the L side 19 has side edges 26 bent towards each other to define a rectilinear channel 27 therebetween, in which the extremity 16 is slidably inserted. A longitudinal section of the L-shaped element 17 is shown in FIG. 5.

Figure 3:
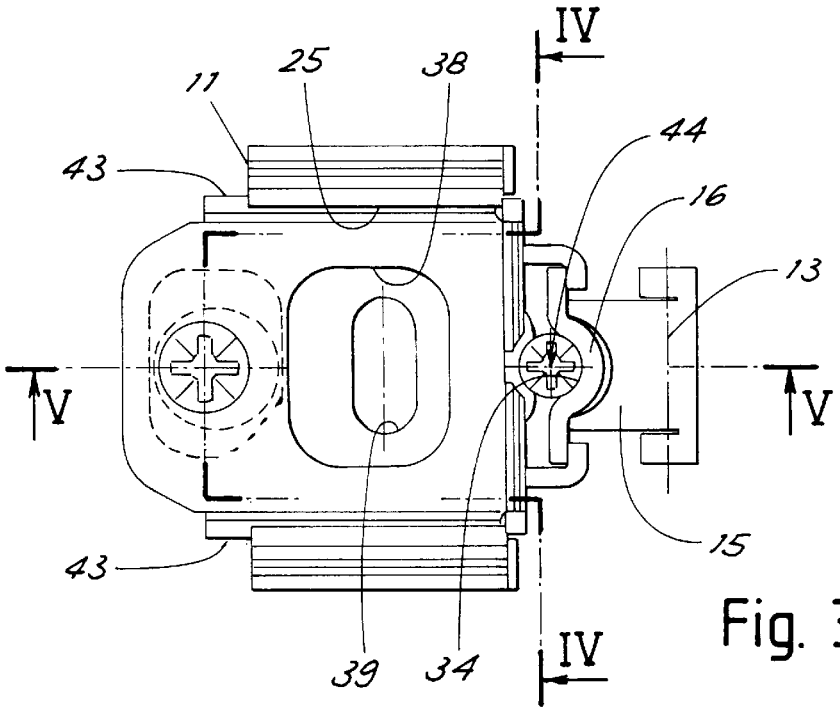
FIG. 3 is a top view of part of the hinge shown in FIG. 1.
Figure 6:
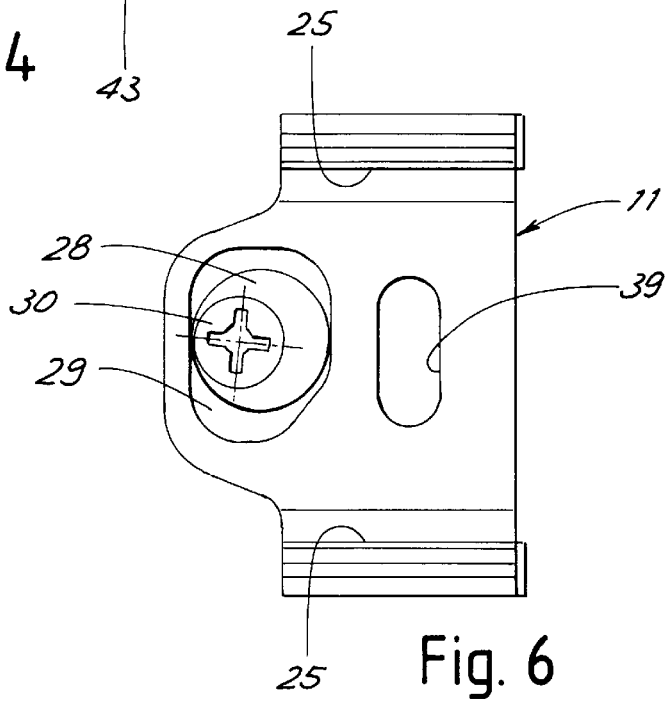
FIG. 6 is a plan view of part of the hinge.

As clearly represented in plan view in FIG. 3, in section in FIG. 4, and again in plan view in FIG. 6 where the L-shaped element has been removed, for adjustment of movement 21 between the base and L-shaped element, the first adjusting means 20 comprises a cam element 28 received in a cam seat 29 in the base. The working end 30 of the cam passes through a hole 31 in the L arm 18 with a minimum play and appears on the upper surface of this L arm with a rotation axis 32 normal to this surface. Thus, upon rotation of the working end 30 (by means of a screwdriver, for example) said sliding 21 between the base and L extremity is caused.

As viewed from FIG. 4, thickness of the assembly consisting of the base, extremity of the L-shaped element ad cam element is relatively small, comparable with the thickness of a normal base for a non-adjustable frame hinge.

The second adjusting means 23 comprises a screw 33 meshing between the second L extremity and the rectilinear end of the pivoting arm. The rotation axis 34 of the screw is parallel to the second L extremity to produce said sliding 22 between the second L extremity and the arm.

Note that the working end of the cam and the rotation head of the screw peep out in the same direction towards the outside of the hinge, so that the adjusting operations are facilitated when the hinge is mounted on a piece of furniture.

For operation of screw 33, while keeping thickness of the assembly consisting of the second L extremity and the rectilinear arm of the pin element as small as possible, it has been found to be advantageous for the facing sliding surfaces of the two parts to define a seat 34 therebetween for receiving the screw. As also clearly viewed from FIG. 7, where the pivoting arm has been removed from the front view of the L-shaped element, the front surface 35 of the L-shaped element is screw-threaded for partial side coupling with the screw thread in the receiving seat. The facing surface of the pivoting arm on the contrary identifies a screw constraint 36 (FIG. 1) against sliding. The constraint can be advantageously achieved through drawing or the like of the seat portion obtained by the pivoting arm so that insertion of the arm in a groove at the end 37 of screw 33 occurs.

As clearly shown in FIGS. 1 and 3, the first L extremity 18 has a wide opening 38 thereon through which a hole 39 opens which is formed in the base 11 and is intended for passage of a screw 40 to fasten the base to the piece of furniture. For the purpose of advantageously providing a third sliding degree 41, orthogonal to the two first degrees, hole 39 for passage of the fastening screw is of elongated shape in a direction transverse both to the sliding direction of the first extremity along the base and to the sliding direction of the arm along the second extremity, so that adjustment of the base position relative to the piece of furniture in this transverse direction 41 is allowed.

At this point it is apparent that the intended purposes have been achieved by providing a hinge of the frame type having up to three adjustment degrees in directions orthogonal to each other, while the hinge bulkiness is maintained of a reduced value and, in particular, also small is the thickness of the base portion adapted to be fastened to the piece of furniture frame.

In addition, the hinge in accordance with the invention is strong, of easy adjustment and cheap manufacture. Furthermore, an adjustment with parallel axes enables easy operation and helps in reducing the hinge sizes.

Obviously, the above description of an embodiment applying the innovative principles of the present invention is given by way of example only and therefore must not be considered as a limitation of the inventive scope as herein claimed. For instance, consistently with the solution herein described and claimed, the exact proportion of the parts can be varied depending on specific requirements.

What is claimed is:

1. A single-pin hinge for furniture comprising a base and a fastening bowl designed to be secured to two parts of the piece of furniture to be hinged on each other around an axis, to the bowl being pivotally mounted, in accordance with said axis, one end of an arm having a rectilinear opposite end and an L-shaped connecting element having a first and a second opposite extremities, the first extremity of the connecting element being constrained to slide in a direction parallel to its extension on said base, said rectilinear end of the arm being constrained to slide in a direction parallel to its extension on the second extremity of the connecting element, first rotating means being disposed between the first extremity of the connecting element and the base for adjustment of the mutual position of same in their sliding direction and second rotating means being disposed between the second extremity of the connecting element and the rectilinear end of the arm for adjustment of the mutual position of same in their sliding direction, the first and second rotating means having rotation axes parallel to each other.

2. The hinge as claimed in claim 1, wherein the first adjusting means comprises a cam element received in a cam seat in said base and with a working end appearing on the surface of the first extremity of the connecting element with a rotation axis normal to said surface to produce said sliding between the base and the first extremity of the connecting element upon rotation of the working end of the cam.

3. The hinge as claimed in claim 2, wherein the second adjusting means comprises a screw meshing between the second extremity of the connecting element and the rectilinear end of the arm and having a rotation axis parallel to the second extremity of the connecting element to produce said sliding between the second extremity and the arm upon rotation of the screw, and wherein the working end of the cam and the rotation head of the screw peep out in the same direction.

4. The hinge as claimed in claim 1, wherein the second adjusting means comprises a screw meshing between the second extremity and the rectilinear end of the arm and having a rotation axis parallel to the second extremity of the connecting element to produce said sliding between the second extremity and the arm upon rotation of the screw.

5. The hinge as claimed in claim 4, wherein the second extremity of the connecting element and the rectilinear end of the arm run with respective facing surfaces defining a receiving seat for the screw therebetween.

6. The hinge as claimed in claim 5, wherein one of the two facing surfaces is screw-threaded for partial side coupling with the screw thread in said receiving seat and the other of said surfaces defines a screw constraint against sliding.

7. The hinge as claimed in claim 1, wherein for the sliding constraint between the base and first extremity of the connecting element, the base defines a top-open rectilinear channel in which said first extremity is slidably inserted, the channel having side walls with edges projecting inwardly of the seat to constitute a sliding guide of said first extremity on the base.

8. The hinge as claimed in claim 7, wherein the sides of the first extremity of the connecting element are slightly bent downward for insertion between two side guides defined by said projecting base edges.

9. The hinge as claimed in claim 1, wherein for the sliding constraint between the arm and the second extremity of the connecting element, said second extremity has the side edges bent towards each other to define a rectilinear channel therebetween in which said second extremity is slidingly fitted.

10. The hinge as claimed in claim 1, wherein when the hinge is in a closed position the second extremity of the conducting element is disposed parallel to the bowl bottom and the first extremity is disposed normal to the bowl bottom and close to a bowl side opposite to the hinging axis of the arm on the bowl.

11. The hinge as claimed in claim 1, wherein said first extremity of the connecting element has an opening therein onto which a hole opens which is intended for passage of a fastening screw between the base and the piece of furniture.

12. The hinge as claimed in claim 11, wherein said hole intended for passage of a screw is of elongated shape in a direction transverse both to the sliding direction of the first extremity along the base and to the sliding direction of the arm along the second extremity, so as to enable adjustment of the base position relative to the piece of furniture in said transverse direction.

13. The hinge as claimed in claim 1, wherein connecting element and the arm are made of bent sheet metal.

* * * * *